US012791214B2

(12) United States Patent
Li et al.

(10) Patent No.: US 12,791,214 B2
(45) Date of Patent: Nov. 10, 2026

(54) AIR CONDITIONER CONTROL SYSTEM AND CONTROL METHOD

(71) Applicant: Gree Electric Appliances, Inc. of Zhuhai, Zhuhai (CN)

(72) Inventors: Zhifeng Li, Zhuhai (CN); Pan Zuo, Zhuhai (CN); Huasheng Yang, Zhuhai (CN)

(73) Assignee: Gree Electric Appliances, Inc. of Zhuhai, Zhuhai (CN)

( * ) Notice: Subject to any disclaimer, the term of this patent is extended or adjusted under 35 U.S.C. 154(b) by 279 days.

(21) Appl. No.: 18/725,628

(22) PCT Filed: Oct. 14, 2022

(86) PCT No.: PCT/CN2022/125248
§ 371 (c)(1),
(2) Date: Jun. 28, 2024

(87) PCT Pub. No.: WO2023/138118
PCT Pub. Date: Jul. 27, 2023

(65) Prior Publication Data

US 2025/0085010 A1 Mar. 13, 2025

(30) Foreign Application Priority Data

Jan. 24, 2022 (CN) ..... 202210081306.9

(51) Int. Cl.
*F24F 11/56* (2018.01)
*F24F 11/63* (2018.01)

(52) U.S. Cl.
CPC ..... *F24F 11/56* (2018.01); *F24F 11/63* (2018.01)

(58) Field of Classification Search
CPC .. F24F 11/63; F24F 11/32; F24F 11/38; F24F 11/50; F24F 11/52; F24F 11/54; F24F 11/56; F24F 11/89; F24F 11/58
See application file for complete search history.

(56) References Cited

U.S. PATENT DOCUMENTS

2023/0332795 A1* 10/2023 Yamaguchi ..... F24F 11/54
2024/0053042 A1* 2/2024 Zheng ..... F24F 11/30
(Continued)

FOREIGN PATENT DOCUMENTS

AU 2020255663 11/2021
CN 1987239 6/2007
(Continued)

OTHER PUBLICATIONS

International Search Report, with a mailing date of Jan. 17, 2023, in International application No. PCT/CN2022/125248, filed on Oct. 14, 2022 (3 pages).
(Continued)

*Primary Examiner* — Mong-Shune Chung
(74) *Attorney, Agent, or Firm* — MCANDREWS HELD & MALLOY, LTD

(57) ABSTRACT

The present disclosure provides an air conditioner control system and a control method. The air conditioner control system includes: an outdoor unit device, one main indoor unit device and at least one secondary indoor unit device, the main indoor unit device and the outdoor unit device are connected to a first communication bus, all indoor unit devices are both connected to a second communication bus; each of the at least one secondary indoor unit device sends a secondary indoor unit state information of itself to the second communication bus; the main indoor unit device acquires the secondary indoor unit state information, and sends an indoor unit state summary information to the first communication bus; the outdoor unit device acquires the
(Continued)

indoor unit state summary information, and when it is determined that there is a fault in indoor unit devices, controls itself to execute an action corresponding to the fault.

20 Claims, 4 Drawing Sheets

(56) References Cited

U.S. PATENT DOCUMENTS

| | | | | |
|---|---|---|---|---|
| 2024/0085046 | A1* | 3/2024 | Tanabe | F24F 11/54 |
| 2024/0102688 | A1* | 3/2024 | Yamamoto | F24F 11/54 |
| 2024/0328671 | A1* | 10/2024 | Tamaki | F24D 11/0214 |

FOREIGN PATENT DOCUMENTS

| | | |
|---|---|---|
| CN | 104033992 | 9/2014 |
| CN | 107071077 | 8/2017 |
| CN | 107166684 | 9/2017 |
| CN | 107218703 | 9/2017 |
| CN | 109506324 | 3/2019 |
| CN | 114484770 | 5/2022 |
| JP | H0271039 | 3/1990 |
| KR | 102129299 | 7/2020 |
| WO | 2020203494 | 10/2020 |

OTHER PUBLICATIONS

CNIPA's Office Action 1 (1 page).
Office Action for Canadian application No. 3,244,663 dated Mar. 2026, 8 pages.

* cited by examiner

AIR CONDITIONER CONTROL SYSTEM AND CONTROL METHOD

CROSS-REFERENCE TO RELATED APPLICATION

The present disclosure is a national stage application of International Patent Application NO. PCT/CN2022/125248, which is filed on Oct. 14, 2022, and claims priority to Chinese patent application No. 202210081306.9, filed on Jan. 24, 2022, the contents of which are hereby incorporated by reference in its entirety.

TECHNICAL FIELD

The present disclosure relates to a technical field of air conditioners, and in particular to an air conditioner control system and a control method.

BACKGROUND

With the development of the technical field of air conditioners, for scenarios with large space areas such as exhibition halls, open office areas and large conference rooms, a multi-split air conditioner system (a system in which one outdoor unit is matched with a plurality of indoor units) appears in the current market, and linkage control of the outdoor unit over the plurality of indoor units can be implemented by the multi-split air conditioner system.

In the multi-split air conditioner system in the related art, in order to realize synchronous control between each of the plurality of indoor units and the outdoor unit, a converter is generally added to connect one outdoor unit with the plurality of indoor units, so that a communication can be established between the indoor units and the outdoor unit, or a plurality of interfaces for communicating with the indoor units are disposed on a controller of the outdoor unit.

SUMMARY

The present disclosure provides an air conditioner control system and a control method, which are capable of reducing the cost of the air conditioner system.

In a first aspect, the present disclosure provides an air conditioner control system, including: an outdoor unit device, one main indoor unit device and at least one secondary indoor unit device, wherein, the main indoor unit device and the outdoor unit device are connected to a first communication bus, and the main indoor unit device and each of the at least one secondary indoor unit device are both connected to a second communication bus;

each of the at least one secondary indoor unit device sends a secondary indoor unit state information of itself to the second communication bus;

the main indoor unit device acquires the secondary indoor unit state information of each of the at least one secondary indoor unit device via the second communication bus, and sends an indoor unit state summary information to the first communication bus according to each piece of the secondary indoor unit state information and a main indoor unit state information of the main indoor unit device; and the outdoor unit device acquires the indoor unit state summary information via the first communication bus, and when it is determined, according to the indoor unit state summary information, that there is a fault in the main indoor unit device or each of the at least one secondary indoor unit device, controls itself to execute an action corresponding to the fault.

In some embodiments, the outdoor unit device is further configured to send an outdoor unit state information of itself to the first communication bus; and the main indoor unit device receives the outdoor unit state information via the first communication bus, and controls itself to perform fault shutdown, when it is determined, according to the outdoor unit state information, that the outdoor unit device has a fault.

In some embodiments, when it is determined that the outdoor unit device has a fault, the main indoor unit device further sends an outdoor unit fault information to the second communication bus; and upon receiving the outdoor unit fault information via the second communication bus, each of the at least one secondary indoor unit device controls itself to perform fault shutdown.

In some embodiments, the air conditioner control system further includes: a terminal controller, wherein the terminal controller is connected to the second communication bus;

the terminal controller is configured to receive an air conditioner control instruction, and send the air conditioner control instruction to the second communication bus; and the main indoor unit device and each of the at least one secondary indoor unit device receive the air conditioner control instruction via the second communication bus, and control working states of themselves according to the air conditioner control instruction.

In some embodiments, the terminal controller receives each piece of the secondary indoor unit state information and the main indoor unit state information of the main indoor unit device via the second communication bus, when there is an indoor unit fault information in each piece of the secondary indoor unit state information and the main indoor unit state information, the terminal controller displays the corresponding indoor unit fault information, or when it is determined, according to each piece of the secondary indoor unit state information and the main indoor unit state information, that there is an indoor unit fault, the terminal controller displays the corresponding indoor unit fault information and sends the indoor unit fault information to the second communication bus.

In some embodiments, the main indoor unit device determines, according to each piece of the secondary indoor unit state information and the main indoor unit state information of the main indoor unit device, whether there is an indoor unit fault, and if there is the indoor unit fault, sends a corresponding indoor unit fault information to the second communication bus; and upon receiving the corresponding indoor unit fault information via the second communication bus, the terminal controller displays the corresponding indoor unit fault information.

In some embodiments, when it is determined that the outdoor unit device has a fault, the main indoor unit device sends an outdoor unit fault information to the second communication bus; and the terminal controller receives the outdoor unit fault information via the second communication bus, and displays the outdoor unit fault information.

In some embodiments, upon receiving the air conditioner control instruction, the terminal controller sends the air conditioner control instruction to the second communication bus; and if receiving the air conditioner control instruction via the second communication bus, the main indoor unit device and each of the at least one secondary indoor unit device respectively generate a corresponding address information according to attribute information of themselves, and send the corresponding address information to the second communication bus.

In some embodiments, the terminal controller is further configured to: if receiving the corresponding address information via the second communication bus, establish association relationships with the main indoor unit device and each of the at least one secondary indoor unit device according to the corresponding address information.

In some embodiments, the main indoor unit device and each of the at least one secondary indoor unit device are further configured to generate a corresponding time response information according to the attribute information of themselves, and output the corresponding address information and the corresponding time response information to the terminal controller.

In some embodiments, when it is determined that there is a fault in the main indoor unit device or each of the at least one secondary indoor unit device, the outdoor unit device controls itself to perform fault shutdown or maintain current state for running according to the type of the fault.

The air conditioner control system includes the outdoor unit device, one main indoor unit device and at least one secondary indoor unit device, a communication connection between the main indoor unit device and the outdoor unit device is established by the first communication bus, and a communication connection between the main indoor unit device and each of the at least one secondary indoor unit device is established by the second communication bus, so that the main indoor unit device can acquire the indoor unit state information via the second communication bus, and summarize the main indoor unit state information and the acquired secondary indoor unit state information, and send the summary information to the first communication bus. Therefore, the outdoor unit device can acquire the indoor unit state summary information via the first communication bus, and when it is determined, according to the indoor unit state summary information, that there is a fault in the main indoor unit device or each of the at least one secondary indoor unit device, the outdoor unit device controls itself to execute the action corresponding to the fault. In this way, information interaction between the outdoor unit device and the main indoor unit device can be implemented, and information interaction between the outdoor unit device and each of the at least one secondary indoor unit device can be implemented. By means of the air conditioner control system, the information interaction between an outdoor unit and each indoor unit can be implemented without additionally adding a converter or a communication interface, so that the cost of the air conditioner system can be effectively reduced.

The present disclosure provides a control method of an air conditioner control system, including: each of at least one secondary indoor unit device sends a secondary indoor unit state information of itself to a second communication bus; a main indoor unit device acquires the secondary indoor unit state information of each of the at least one secondary indoor unit device via a second communication bus, and sends an indoor unit state summary information to the first communication bus according to each piece of the secondary indoor unit state information and a main indoor unit state information of the main indoor unit device; and an outdoor unit device acquires the indoor unit state summary information via the first communication bus, and when it is determined, according to the indoor unit state summary information, that there is a fault in the main indoor unit device or each of the at least one secondary indoor unit device, controls itself to execute an action corresponding to the fault, wherein the main indoor unit device and the outdoor unit device are connected to the first communication bus, and the main indoor unit device and each of the at least one secondary indoor unit device are both connected to the second communication bus.

In some embodiments, the control method further includes: the outdoor unit device sends an outdoor unit state information of itself to the first communication bus; and the main indoor unit device receives the outdoor unit state information via the first communication bus, and controls itself to perform fault shutdown, when it is determined, according to the outdoor unit state information, that the outdoor unit device has a fault.

In some embodiments, the control method further includes: when it is determined that the outdoor unit device has the fault, the main indoor unit device sends an outdoor unit fault information to the second communication bus; and upon receiving the outdoor unit fault information via the second communication bus, each of the at least one secondary indoor unit device controls itself to perform fault shutdown.

In some embodiments, the control method further includes: a terminal controller receives an air conditioner control instruction, and sends the air conditioner control instruction to the second communication bus; and the main indoor unit device and each of the at least one secondary indoor unit device receive the air conditioner control instruction via the second communication bus, and control working states of themselves according to the air conditioner control instruction.

In some embodiments, the control method further includes: the terminal controller receives each piece of the secondary indoor unit state information and the main indoor unit state information of the main indoor unit device via the second communication bus; when there is an indoor unit fault information in each piece of the secondary indoor unit state information and the main indoor unit state information, displays the corresponding indoor unit fault information, or when it is determined, according to each piece of the secondary indoor unit state information and the main indoor unit state information, that there is an indoor unit fault, displays the corresponding indoor unit fault information; and sends the indoor unit fault information to the second communication bus.

In some embodiments, the control method further includes: the main indoor unit device determines, according to each piece of the secondary indoor unit state information and the main indoor unit state information of the main indoor unit device, whether there is an indoor unit fault, and if there is the indoor unit fault, sends a corresponding indoor unit fault information to the second communication bus; and upon receiving the corresponding indoor unit fault information via the second communication bus, the terminal controller displays the corresponding indoor unit fault information.

In some embodiments, the control method further includes: when it is determined that the outdoor unit device has a fault, the main indoor unit device sends an outdoor unit fault information to the second communication bus; and the terminal controller receives the outdoor unit fault information via the second communication bus, and displays the outdoor unit fault information.

In some embodiments, the control method further includes: if receiving the air conditioner control instruction via the second communication bus, the main indoor unit device and each of the at least one secondary indoor unit device respectively generates a corresponding address information according to attribute information of themselves, and sends the corresponding address information to the second communication bus.

In some embodiments, the control method further includes: if receiving the corresponding address information via the second communication bus, the terminal controller establishes association relationships with the main indoor unit device and each of the at least one secondary indoor unit device according to the corresponding address information.

In some embodiments, the control method further includes: the main indoor unit device and each of the at least one secondary indoor unit device generates a corresponding time response information according to the attribute information of themselves, and outputs the corresponding address information and the corresponding time response information to the terminal controller.

In some embodiments, the control method further includes: when it is determined that there is a fault in the main indoor unit device or each of the at least one secondary indoor unit device, the outdoor unit device controls itself to perform fault shutdown or maintain current state for running according to the type of the fault.

BRIEF DESCRIPTION OF THE DRAWINGS

The drawings described herein are used for providing a further understanding of the present disclosure and constitute a part of the present disclosure, exemplary embodiments of the present disclosure and descriptions thereof are used for explaining the present disclosure, and do not constitute an improper limitation on the present disclosure.

DETAILED DESCRIPTION OF THE EMBODIMENTS

Figure 1:
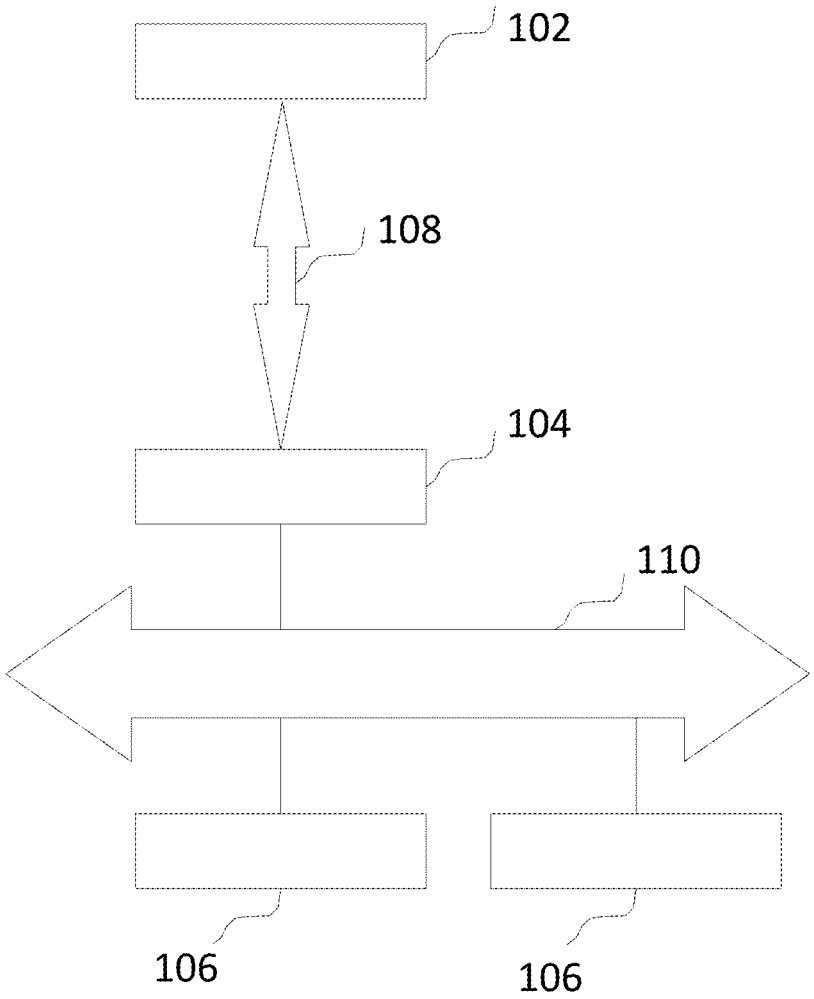
FIG. 1 is a schematic structural diagram of an air conditioner control system in some embodiments.

In order to make the above objectives, features and advantages of the present disclosure clearer and more comprehensible, specific implementations of the present disclosure are further described in detail below in combination with drawings. In the following description, numerous specific details are set forth to fully understand the present disclosure. However, the present disclosure can be implemented in many different ways than those described herein, and those skilled in the art can make similar improvements without departing from the connotation of the present disclosure, thus the present disclosure is not limited by the specific embodiments disclosed below.

In the description of the present disclosure, it should be understood that orientation or position relationships indicated by terms "center", "longitudinal", "transverse", "length", "width", "thickness", "upper", "lower", "front", "rear", "left", "right", "vertical", "horizontal", "top", "bottom", "inside", "outside", "clockwise", "counterclockwise", "axial", "radial", "circumferential" and the like are orientation or position relationships shown on the basis of the drawings, and are merely for the convenience of describing the present disclosure and simplifying the description, but do not indicate or imply that referred apparatuses or elements must have specific orientations or must be constructed and operated in specific orientations, and thus cannot be construed as limitations to the present disclosure.

In addition, the terms "first" and "second" are used for descriptive purposes only and cannot be understood as indicating or implying relative importance or implicitly indicating the number of indicated technical features. Thus, the features defined with "first" and "second" can explicitly or implicitly include at least one of the features. In the description of the present disclosure, "a plurality of" means at least two, for example, two or three, unless explicitly specified otherwise.

In the present disclosure, unless otherwise explicitly specified and limited, terms such as "installed", "connected" and "connection" should be understood in a broad sense. For example, the connection can be a fixed connection, and can also be a detachable connection, or an integral connection; can be a mechanical connection, and can also be an electrical connection; and can be a direct connection, can be an indirect connection via an intermediate medium, and can also be internal communication between two elements or an interaction relationship between the two elements, unless explicitly defined otherwise. For those ordinary skilled in the art, the specific meanings of the above terms in the present disclosure can be understood according to specific situations.

In the present disclosure, unless otherwise expressly specified and limited, a first feature being "on" or "under" a second feature can be a direct contact between the first feature and the second feature, or an indirect contact between the first feature and the second feature via an intermediate medium. Moreover, the first feature being "on", "above" and "over" the second feature can be that the first feature is directly above or obliquely above the second feature, or merely indicates that a horizontal height of the first feature is higher than that of the second feature. The first feature being "under", "below" and "beneath" the second feature can be that the first feature is directly below or obliquely below the second feature, or merely indicates that the horizontal height of the first feature is less than that of the second feature.

It should be noted that, when an element is referred to as being "fixed to" or "disposed on" another element, it can be directly on the other element or there can be an intervening element. When one element is considered to be "connected" to another element, it can be directly connected to the other element or there can be an intervening element at the same time. The terms "vertical", "horizontal", "upper", "lower", "left", "right" and similar expressions used herein are for illustrative purposes only and are not intended to represent a unique embodiment.

The inventor believes that the manner of adding a converter or a communication interface in the related art not only has a complex hardware structure, but also increases the cost.

In a first aspect of the present disclosure, provides an air conditioner control system, as shown in FIG. 1, including: an outdoor unit device 102, one main indoor unit device 104 and at least one secondary indoor unit device 106, wherein among the indoor unit devices, the indoor unit device connected with the outdoor unit device 102 via a first communication bus 108 is used as the main indoor unit device 104, and the remaining indoor unit devices are used as secondary indoor unit devices 106, and the main indoor unit device 104 and each of the at least one secondary indoor unit device 106 are both connected to a second communication bus 110. In some embodiments, there is one or more secondary indoor unit devices 106. In some embodiments, the number of the secondary indoor unit devices 106 is adjusted according to actual scenario requirements, and it is taken as an example for description in the embodiments of the present disclosure that there are two secondary indoor unit devices 106.

In some embodiments, the outdoor unit device 102 and the main indoor unit device 104 can be connected by pipes, the outdoor unit device 102 and each of the at least one secondary indoor unit device 106 can be connected by pipes. Specifically, in some embodiments, when there are a plurality of indoor unit devices, according to the number of the secondary indoor unit devices, a main pipeline is divided into branch pipelines corresponding to the number, the outdoor unit device 102 is respectively connected with corresponding indoor unit devices via each of the branch pipelines. for example, the embodiments of the present disclosure include one main indoor unit device 104 and two secondary indoor unit devices 106, and then the outdoor unit device 102 is connected with the main indoor unit device 104 and the two secondary indoor unit devices 106 respectively via three branch pipelines. Specifically, the outdoor unit device 102 is a device including an evaporator, a compressor, a condenser pipe, a sensor, a control chip and other structures. During a working process of the air conditioner control system, on one hand, the compressor can compress a refrigerant into a high-temperature and high-pressure gas, and then conveys the gas into the condenser, after the refrigerant reaches the condenser, the refrigerant can be condensed and cooled, is rotated by a fan, and is conveyed by the branch pipelines to air outlets of the main indoor unit device 104 and each of the at least one secondary indoor unit device 106, thereby achieving an effect of indoor heating. On the other hand, the compressor can also compress a gaseous refrigerant into a high-temperature and high-pressure gas, and then convey the gas into the condenser, the high-temperature and high-pressure refrigerant dissipates heat through the condensation of the condenser to form low-temperature and high-pressure refrigerant liquid, and the refrigerant that becomes the liquid enters the air outlets of the main indoor unit device 104 and each of the at least one secondary indoor unit device 106 from the branch pipelines, at this time, the indoor temperature gradually decreases, thereby achieving an effect of indoor refrigeration. In some embodiments, both the main indoor unit device 104 and the secondary indoor unit device 106 refer to devices including structures such as an air outlet, a control chip and a sensor.

The main indoor unit device 104 and the outdoor unit device 102 are connected to the first communication bus 108, so that the main indoor unit device 104 can realize data sharing with the outdoor unit device 102 via the first communication bus 108. Specifically, the main indoor unit device 104 can send a main indoor unit state information of itself to the first communication bus 108, so that the outdoor unit device 102 can acquire the main indoor unit state information via the first communication bus 108. In some embodiments, the main indoor unit state information refers to operation parameters and fault information of the main indoor unit device 104, the operation parameters include a load state parameter, a sensor value, and the like, and the fault information includes a specific fault symbol, a fault code, and the like.

In some embodiments, the main indoor unit device 104 and each of the at least one secondary indoor unit device 106 are both connected to the second communication bus 110, so that the main indoor unit device 104 can realize data sharing with each of the at least one secondary indoor unit device 106 via the second communication bus 110. Specifically, in some embodiments, each of the at least one secondary indoor unit device 106 sends a secondary indoor unit state information of itself to the second communication bus 110, so that the main indoor unit device 104 can acquire the secondary indoor unit state information of each of the at least one secondary indoor unit device 106 via the second communication bus 110. In some embodiments, the secondary indoor unit state information refers to operation parameters and fault information of each of the at least one secondary indoor unit device 106, the operation parameters include a load state parameter, a sensor value, and the like, and the fault information includes a specific fault symbol, a fault code, and the like.

In some embodiments, the main indoor unit device 104 acquires the secondary indoor unit state information of each of the at least one secondary indoor unit device 106 via the second communication bus 110, and summarizes each pieces of the secondary indoor unit state information and the main indoor unit state information of the main indoor unit device 104 to obtain summarized indoor unit state summary information, and finally sends the indoor unit state summary information to the first communication bus 108; and the outdoor unit device 102 can acquire the indoor unit state summary information via the first communication bus 108, and when it is determined, according to the indoor unit state summary information, that there is a fault in the main indoor unit device 104 or each of the at least one secondary indoor unit device 106, the outdoor unit device 102 controls itself to execute an action corresponding to the fault, wherein by means of sending the indoor unit state summary information rather than separately sending each piece of the indoor unit state information, it is conducive to reducing energy consumption in a data transmission process.

In some embodiments, after receiving the indoor unit state summary information, if it is determined that there is a fault in the main indoor unit device 104 or each of the at least one secondary indoor unit device 106, the outdoor unit device 102 controls itself to perform fault shutdown or maintains current state for running. In some embodiments, whether the outdoor unit device 102 controlling itself to perform fault shutdown or maintaining current state for running is determined by the type of the fault. Specifically, in some embodiments, if the type of the fault is a compressor condensation or frosting fault, at this time, it indicates that the load of a motor is aggravated, then after a faulty indoor unit stops running, the fault is alleviated, and the outdoor unit device 102 maintains the current state for running; and if the type of the fault is that a suction and exhaust valve plate of the compressor is damaged, at this time, the type of the fault is a mechanical fault, troubleshooting needs to performed after an outdoor unit stop running, and then the outdoor unit device 102 controls itself to perform fault shutdown.

The air conditioner control system includes an outdoor unit device, one main indoor unit device and at least one secondary indoor unit device, a communication connection between the main indoor unit device and the outdoor unit device is established by the first communication bus, and a communication connection between the main indoor unit device and each of the at least one secondary indoor unit device is established by the second communication bus, so that the main indoor unit device can summarize the main indoor unit state information and the acquired secondary indoor unit state information of each of the at least one secondary indoor unit device via the second communication bus, and send the summary information to the first communication bus. Therefore, the outdoor unit device can acquire the indoor unit state summary information via the first communication bus, and when it is determined, according to the indoor unit state summary information, that there is a fault in the main indoor unit device or each of the at least one secondary indoor unit device, the outdoor unit device controls itself to execute the action corresponding to the fault. By means of the air conditioner control system, information interaction between the outdoor unit and each indoor unit can be implemented without additionally adding a converter or a communication interface, so that the cost of the air conditioner system can be effectively reduced.

In some embodiments, the outdoor unit device 102 also sends an outdoor unit state information of itself to the first communication bus 108, so that the main indoor unit device 104 can receive the outdoor unit state information via the first communication bus 108, and control itself to perform fault shutdown, when it is determined, according to the outdoor unit state information, that the outdoor unit device 102 has a fault. In some embodiments, the outdoor unit state information refers to operation parameters and fault information of the outdoor unit device 102, the operation parameters include a load state parameter, a sensor value, and the like, and the fault information includes a specific fault symbol, a fault code, and the like. After a fault occurs in the outdoor unit device 102, the main indoor unit device 104 can timely perform shutdown in response to the fault information, thereby avoiding unnecessary energy loss.

In some embodiments, when it is determined that the outdoor unit device 102 has a fault, the main indoor unit device 104 further sends an outdoor unit fault information to the second communication bus 110, so that upon receiving the outdoor unit fault information via the second communication bus 110, each of the at least one secondary indoor unit device 106 controls itself to perform fault shutdown. Each of the at least one secondary indoor unit device 106 can also acquire the information of the outdoor unit device 102 without the need to dispose a communication interface between the outdoor unit device 102 and each of the at least one secondary indoor unit device 106, so that each of the at least one secondary indoor unit device 106 controls itself to perform fault shutdown by means of responding to the outdoor unit fault information in time, thereby avoiding unnecessary energy loss.

Figure 2:
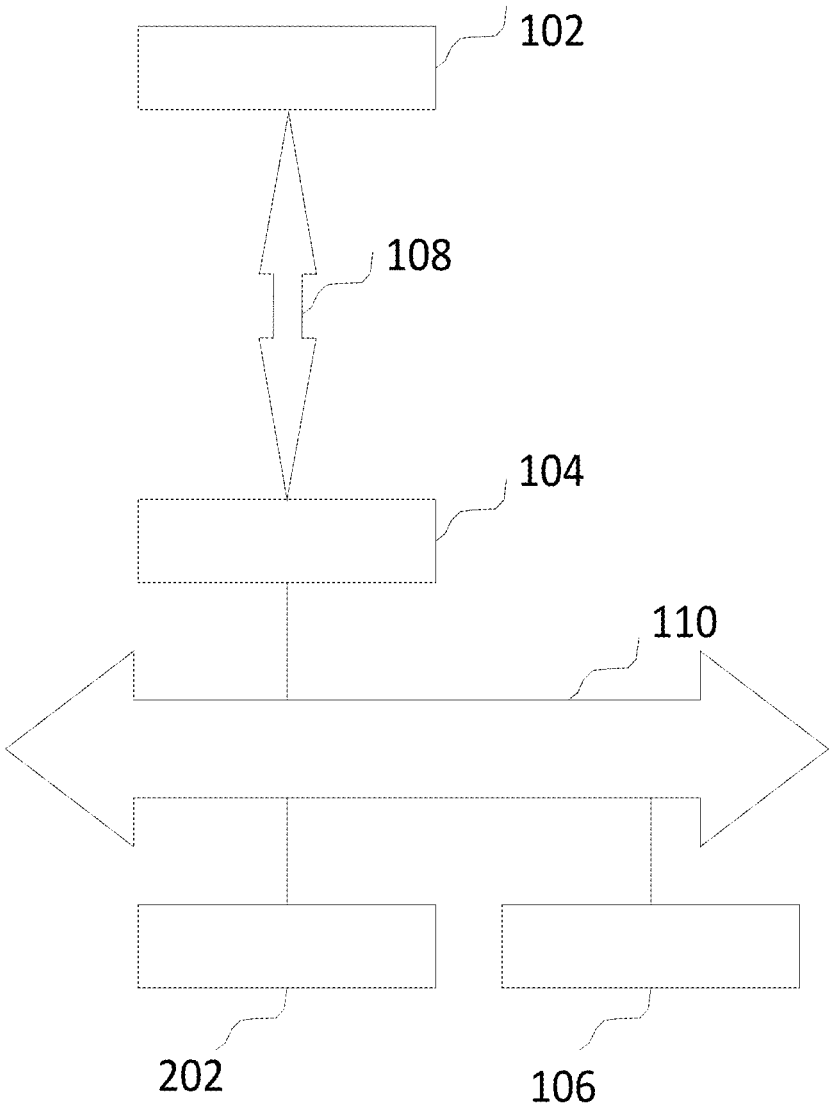
FIG. 2 is a schematic flowchart of an air conditioner control system in some other embodiments.

In some embodiments, as shown in FIG. 2, on the basis of the above embodiments, the air conditioner control system in the present embodiment further includes: a terminal controller 202. In some embodiments, the terminal controller 202 is a user-oriented terminal control device, and a user can set a set temperature, a mode and the like of each indoor unit via the terminal controller, wherein the terminal controller 202 is connected to the second communication bus 110, and the terminal controller 202 can be used for receiving an air conditioner control instruction, and sending the air conditioner control instruction to the second communication bus 110; and the main indoor unit device 104 and each of the at least one secondary indoor unit device 106 can receive the air conditioner control instruction via the second communication bus 110, and control working states of themselves according to the air conditioner control instruction.

For example, in some embodiments, the air conditioner control instruction refers to an instruction for triggering the main indoor unit device 104 and each of the at least one secondary indoor unit device 106 to enter a certain working mode. In some embodiments, the air conditioner control instruction refers to an instruction for entering a multi-split mode (that is, a mode in which the outdoor unit device 102 drives the main indoor unit device 104 and each of the at least one secondary indoor unit device 106 to run). In some embodiments, the air conditioner control instruction refers to an instruction for executing one-driving-one mode (that is, a mode in which the outdoor unit device 102 only drives the main indoor unit device 104 to run). Specifically, when the user selects the multi-split mode, the terminal controller 202 acquires the air conditioner control instruction, or after the user selects the multi-split mode and further sends a specific instruction such as starting working, the terminal controller 202 acquires the air conditioner control instruction.

In some embodiments, the air conditioner control instruction is built-in, when a built-in limiting condition of the terminal controller 202 is satisfied, it is determined that the air conditioner control instruction is received, and the main indoor unit device and each of the at least one secondary indoor unit device are triggered by the built-in air conditioner control instruction to enter a certain working mode. In some embodiments, the built-in limiting condition is to set a specific time interval or set a specific time point, for example, it is set that the main indoor unit device 104 and each of the at least one secondary indoor unit device 106 enter the multi-split mode after every 24 hours, and when the interval time period is reached, the condition of the main indoor unit device 104 and each of the at least one secondary indoor unit device 106 for entering the multi-split mode is satisfied; and as another example, a predetermined time point is further set, and when the predetermined time point is reached, a time when the main indoor unit device and each of the at least one secondary indoor unit device enter the multi-split mode is reached. Specifically, in some embodiments, the predetermined time point is 2:00 PM, and when the time reaches 2:00 PM, the condition of the main indoor unit device and each of the at least one secondary indoor unit device for entering the multi-split mode is satisfied.

In some embodiments, after receiving the air conditioner control instruction via the second communication bus 110, the main indoor unit device 104 and each of the at least one secondary indoor unit device 106 respectively randomly generate corresponding address information according to attribute information of themselves, and send the corresponding address information to the second communication bus 110. In some embodiments, the attribute information refers to feature values of the main indoor unit device 104 and each of the at least one secondary indoor unit device 106 themselves, therefore the main indoor unit device 104 and each of the at least one secondary indoor unit device 106 generate IP (Internet Protocol) addresses, and send the IP addresses to the second communication bus 110.

After the main indoor unit device 104 and each of the at least one secondary indoor unit device 106 send the respective corresponding address information to the second communication bus 110, if receiving the corresponding address information via the second communication bus 110, the terminal controller 202 establishes association relationships with the main indoor unit device 104 and each of the at least one secondary indoor unit device 106 according to the corresponding address information. Specifically, the terminal controller 202 respectively establishes a unique correspondence with the main indoor unit device 104 and each of the at least one secondary indoor unit device 106 via the respective corresponding address information, and if a fault occurs in the main indoor unit device 104 or each of the at least one secondary indoor unit device 106 subsequently, the faulty device can be accurately located by the terminal controller 202, so that the user can conveniently and quickly find a fault source, thereby improving the working efficiency.

In some embodiments, in addition to generating the corresponding address information according to the attribute information of themselves, the main indoor unit device 104 and each of the at least one secondary indoor unit device 106 also generate corresponding time response information, and output the corresponding address information and the corresponding time response information to the terminal controller 202.

In some embodiments, if there is the same address information in the respective corresponding address information, the terminal controller 202 determines, according to the time response information corresponding to the same address information, the association relationships with the main indoor unit device 104 and each of the at least one secondary indoor unit device 106.

Specifically, in some embodiments, if there is the same address information in the respective corresponding address information, the time response information corresponding to the same address information is determined, and whether the association relationship is preferentially established with the main indoor unit device 104 or each of the at least one secondary indoor unit device 106 is determined according to the time response information. For example, when the main indoor unit device 104 and one of the at least one secondary indoor unit device 106 generate the same address information, one of the main indoor unit device 104 and the secondary indoor unit device 106, which has a shorter response time in the time response information, is preferentially selected to establish the association relationship, or one of the main indoor unit device 104 and the secondary indoor unit device 106, which has a longer response time in the time response information, is preferentially selected to establish the association relationship. In the embodiment of the present disclosure, it is taken as an example for description that one of the main indoor unit device 104 and the secondary indoor unit device 106, which has the shorter response time in the time response information, is preferentially selected to establish the association relationship, specifically, if the main indoor unit device 104 in the main indoor unit device 104 and the secondary indoor unit device 106 has the shorter response time in the time response information, a connection is first established with the main indoor unit device 104, and prompt information carrying the attribute information is output to the second communication bus 110, the secondary indoor unit device 106 corresponding to the attribute information re-updates the address information to obtain updated address information, and outputs the updated address information to the second communication bus 110, until the main indoor unit device 104 and each of the at least one secondary indoor unit device 106 each have a unique correspondence with the terminal controller 202.

In some embodiments, after the terminal controller 202 establishes the association relationships with the main indoor unit device 104 and each of the at least one secondary indoor unit device 106, the terminal controller 202 receives each piece of the secondary indoor unit state information and the main indoor unit state information of the main indoor unit device 104 via the second communication bus 110, and when there is an indoor unit fault information in each piece of the secondary indoor unit state information and the main indoor unit state information, the terminal controller 202 displays the corresponding indoor unit fault information, or when it is determined, according to each piece of the secondary indoor unit state information and the main indoor unit state information, that there is an indoor unit fault, the terminal controller 202 displays the corresponding indoor unit fault information; and the terminal controller 202 sends the indoor unit fault information to the second communication bus 110. In some embodiments, after receiving the main indoor unit state information and the secondary indoor unit state information, the terminal controller 202 performs fault analysis on the main indoor unit state information and the secondary indoor unit state information, so as to determine whether there is a fault, or directly extracts the indoor unit fault information from each piece of the secondary indoor unit state information and the main indoor unit state information. Since the terminal controller 202 establishes the association relationships with the main indoor unit device 104 and each of the at least one secondary indoor unit device 106, when displaying the indoor unit fault information, the terminal controller 202 can also specifically display which indoor unit device has a fault, thereby greatly improving the maintenance efficiency of a worker.

In some embodiments, the main indoor unit device 104 determines whether there is an indoor unit fault according to each piece of the secondary indoor unit state information and the main indoor unit state information of the main indoor unit device 104, and if there is an indoor unit fault, sends corresponding indoor unit fault information to the second communication bus 110; and when receiving the indoor unit fault information via the second communication bus 110, the terminal controller 202 displays the indoor unit fault information. Specifically, in some embodiments, the main indoor unit device 104 autonomously analyzes the main indoor unit state information and the secondary indoor unit state information, so as to determine whether there is an indoor unit fault, and when it is determined that there is an indoor unit fault, sends corresponding indoor unit fault information to the second communication bus 110, so that the data transmission amount can be effectively reduced, and the data transmission efficiency can be improved.

In some embodiments, when it is determined that the outdoor unit device 102 has a fault, the main indoor unit device 104 further sends outdoor unit fault information to the second communication bus; and the terminal controller 202 receives the outdoor unit fault information via the second communication bus 110, and displays the outdoor unit fault information. Therefore, each of the at least one secondary indoor unit device 106 can also receive the outdoor unit fault information and perform fault shutdown, and the outdoor unit fault information can also be displayed on the terminal controller 202, so that the worker can conveniently perform corresponding maintenance works for the fault.

To make the objectives, technical solutions and advantages of the present disclosure clearer, the present disclosure will be further described in detail with reference to the drawings and one specific embodiment. It should be understood that the specific embodiment described herein is merely used for explaining the present disclosure, and is not intended to limit the present disclosure.

Figure 3:
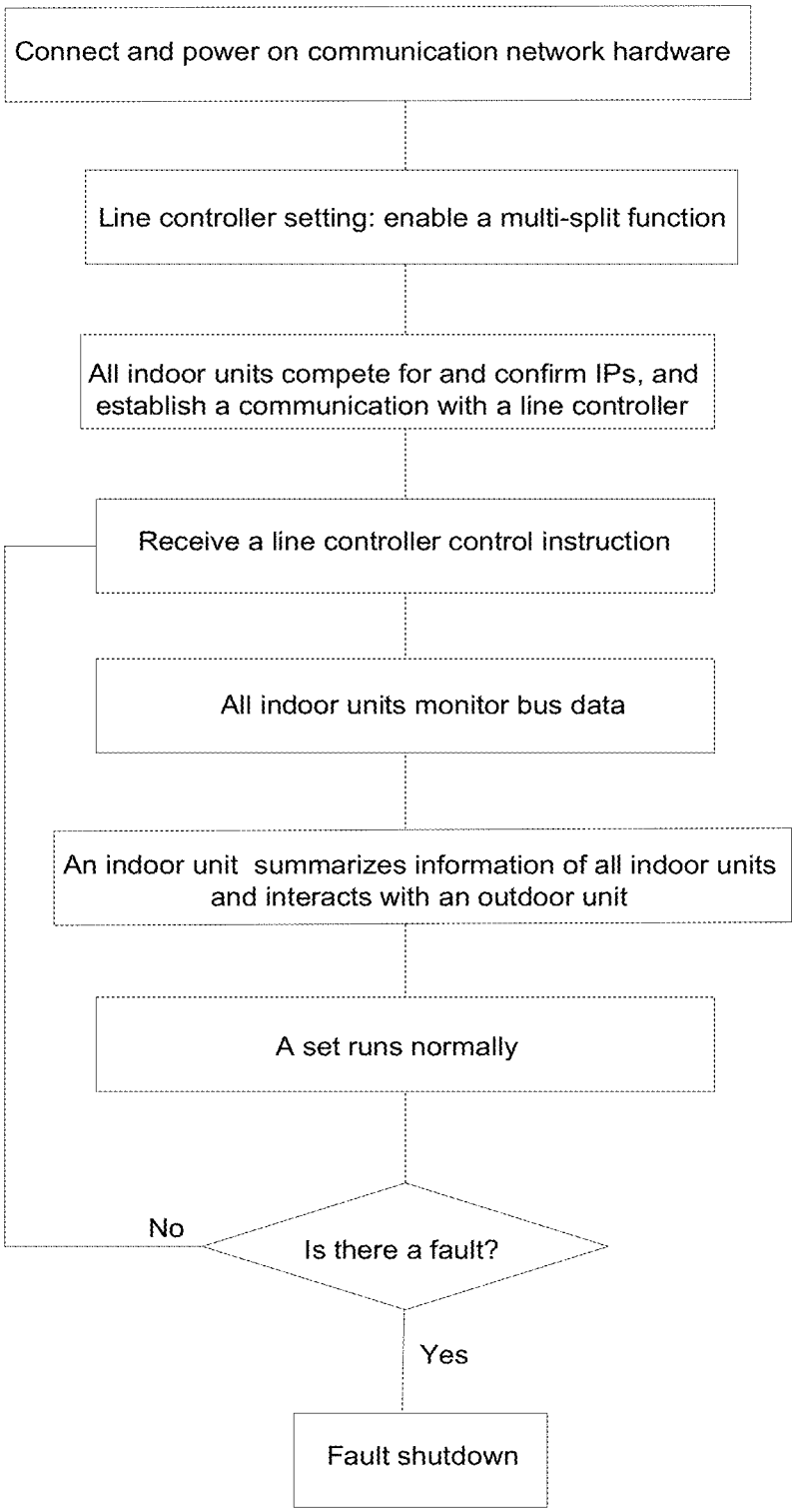
FIG. 3 is a schematic flowchart of a control method of an air conditioner control system in some embodiments.

As shown in FIG. 3, it is a schematic flowchart of a control method of an air conditioner control system in a specific embodiment.

The present embodiment is described by taking as an example, an air conditioner control system including an outdoor unit device, one main indoor unit device, two secondary indoor unit devices and a terminal controller. The main indoor unit device and the outdoor unit device are connected to a first communication bus, the main indoor unit device and the two secondary indoor unit devices are all connected to a second communication bus, and the terminal controller is connected to the second communication bus.

In some embodiments, after the air conditioner control system is powered on, the terminal controller is configured to receive an air conditioner control instruction and send the air conditioner control instruction to the second communication bus; and the main indoor unit device and each of the two secondary indoor unit device receive the air conditioner control instruction via the second communication bus, and control working states of themselves according to the air conditioner control instruction. Specifically, in some embodiments, the air conditioner control instruction is a multi-split control instruction, after receiving the air conditioner control instruction via the second communication bus, the main indoor unit device and each of the two secondary indoor unit device randomly generate corresponding address information according to attribute information of themselves, respectively, which specifically include: generating the address information by using a preset address information generation algorithm, and sending the respective corresponding address information to the second communication bus. In some embodiments, the attribute information refers to feature values of the main indoor unit device and each of the two secondary indoor unit device themselves, therefore the main indoor unit device and each of the two secondary indoor unit device generate IP (Internet Protocol) addresses, and send the IP addresses to the second communication bus.

In some embodiments, after the main indoor unit device and each of the two secondary indoor unit device send the respective corresponding address information to the second communication bus, if receiving the corresponding address information via the second communication bus, the terminal controller establishes association relationships with the main indoor unit device and each of the two secondary indoor unit device according to the respective corresponding address information, and if a fault occurs in the main indoor unit device or each of the two secondary indoor unit device subsequently, the faulty device can be accurately located by the terminal controller, so that the user can conveniently and quickly find a fault source, thereby improving the working efficiency.

In some embodiments, during the working process of the air conditioner control system, each of the two secondary indoor unit device sends secondary indoor unit state information of itself to the second communication bus, the main indoor unit device acquires the secondary indoor unit state information of each of the two secondary indoor unit device via the second communication bus, summarizes each piece of the secondary indoor unit state information and the main indoor unit state information of the main indoor unit device, and sends indoor unit state summary information to the first communication bus, wherein by means of sending the indoor unit state summary information rather than separately sending each piece of the indoor unit state information, it is conducive to reducing energy consumption in a data transmission process.

The outdoor unit device can acquire the indoor unit state summary information via the first communication bus, and when it is determined, according to the indoor unit state summary information, that there is a fault in the main indoor unit device or each of the two secondary indoor unit device, control itself to execute an action corresponding to the fault. Specifically, in some embodiments, after receiving the indoor unit state summary information, if it is determined that there is a fault in the main indoor unit device or each of the two secondary indoor unit device, the outdoor unit device controls itself to perform fault shutdown or maintains current state for running. In some embodiments, whether the outdoor unit device controlling itself to perform fault shutdown or maintaining the current state for running is determined by the type of the fault, if the type of the fault is a compressor condensation or frosting fault, at this time, it indicates that the load of a motor is aggravated, then after the faulty indoor unit stops running, the fault is alleviated, and the outdoor unit device maintains the current state for running; and if the type of the fault is that a suction and exhaust valve plate of the compressor is damaged, at this time, the type of the fault is a mechanical fault, troubleshooting needs to performed after an outdoor unit stop running, and then the outdoor unit device controls itself to perform fault shutdown.

In some embodiments, the outdoor unit device sends an outdoor unit state information of itself to the first communication bus, so that the main indoor unit device can receive the outdoor unit state information via the first communication bus, and control itself to perform fault shutdown when it is determined, according to the outdoor unit state information, that the outdoor unit device has a fault. When it is determined that the outdoor unit device has a fault, the main indoor unit device further sends an outdoor unit fault information to the second communication bus, so that each of the two secondary indoor unit device controls itself to perform fault shutdown upon receiving the outdoor unit fault information via the second communication bus; and the terminal controller receives the outdoor unit fault information via the second communication bus, and displays the outdoor unit fault information. Therefore, the outdoor unit fault information can also be displayed on the terminal controller, so that the worker can conveniently perform corresponding maintenance works for the fault.

It should be understood that, although the steps in the flowcharts involved in the above embodiments are sequentially displayed according to the indication of arrows, these steps are not necessarily executed in sequence according to the order indicated by the arrows. Unless explicitly stated herein, the execution of these steps is not strictly limited, and these steps can be executed in other orders. Moreover, at least part of the steps in the flowcharts involved in the above embodiments can include a plurality of steps or a plurality of stages, and these steps or stages are not necessarily executed at the same moment, but can be executed at different moments, and the execution order of these steps or stages is not necessarily executed in sequence, but can be executed in turn or alternately with other steps or at least part of steps or stages in the other steps.

Figure 4:
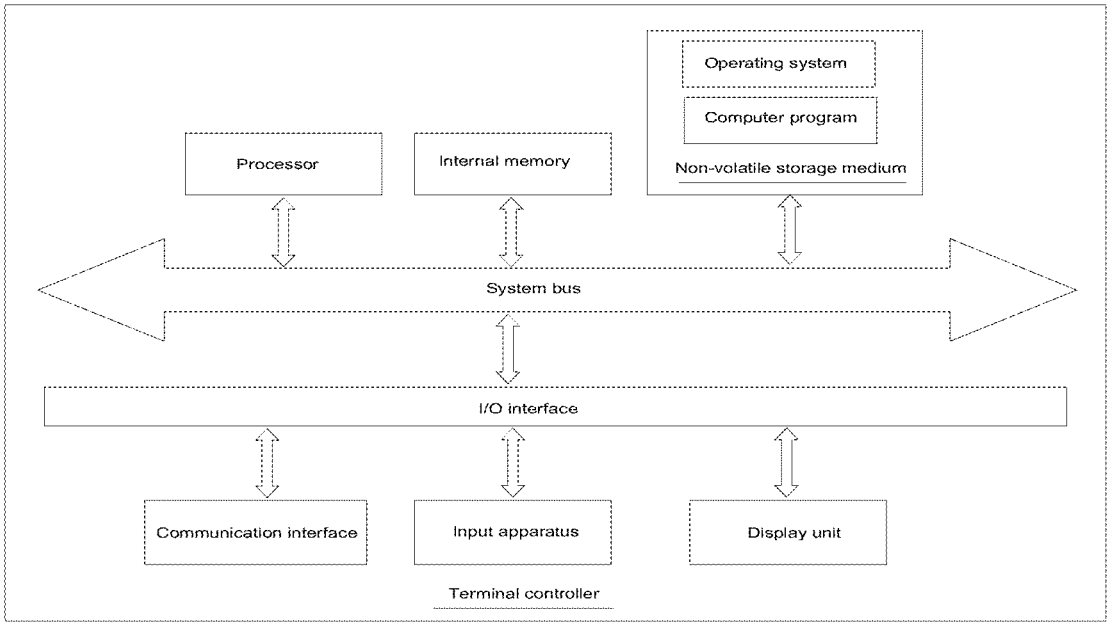
FIG. 4 is an internal structure diagram of a terminal controller in some embodiments.

In one embodiment, a terminal controller is provided, wherein the terminal controller can be a terminal, and an internal structure diagram of the terminal controller can be shown in FIG. 4. The terminal controller includes a processor, a memory, a communication interface, a display screen and an input apparatus, which are connected by using a system bus. The processor of the terminal controller is used for providing computing and control capabilities. The memory of the terminal controller includes a non-volatile storage medium and an internal memory. The non-volatile storage medium stores an operating system and a computer program. The internal memory provides an environment for the operation of the operating system and the computer program in the non-volatile storage medium. The communication interface of the terminal controller is used for communicating with an external terminal in a wired or wireless manner, and the wireless manner can be implemented by WiFi, a mobile cellular network, NFC (near field communication), or other technologies. The display screen of the terminal controller can be a liquid crystal display screen or an electronic ink display screen, and the input apparatus of the terminal controller can be a touch layer covered on the display screen, or can be a button, a trackball or a touchpad disposed on a terminal controller housing, or can be an external keyboard, an external touchpad, an external mouse, or the like.

Those skilled in the art can understand that the structure shown in FIG. 4 is merely a block diagram of a partial structure related to the solutions of the present disclosure, and does not constitute a limitation on the terminal controller to which the solutions of the present disclosure are applied, and the specific terminal controller can include more or fewer components than those shown in the figure, or combine some components, or have different component arrangements.

Those ordinary skilled in the art can understand that all or some processes of the method in the above embodiments can be implemented by instructing related hardware by using a computer program, the computer program can be stored in a non-volatile computer-readable storage medium, and when the computer program is executed, the processes of the embodiments of the above methods can be included. Any reference to a memory, a database or another medium used in the embodiments provided in the present disclosure can include at least one of a non-volatile memory and a volatile memory. The non-volatile memory can include a read-only memory (ROM), a magnetic tape, a floppy disk, a flash memory, an optical memory, a high-density embedded non-volatile memory, a resistive random access memory (ReRAM), a magnetoresistive random access memory (MRAM), a ferroelectric random access memory (FRAM), a phase change memory (PCM), a graphene memory, and the like. The volatile memory can include a random access memory (RAM) or an external cache memory. By way of illustration and not limitation, the RAM can be in a variety of forms, for example, a static random access memory (SRAM) or a dynamic random access memory (DRAM). The database involved in the embodiments provided in the present disclosure can include at least one of a relational database and a non-relational database. The non-relational database can include a blockchain-based distributed database, and the like, which is not limited thereto. The processor involved in the embodiments provided in the present disclosure can be a general-purpose processor, a central processor, a graphics processor, a digital signal processor, a programmable logic device, a data processing logic device based on quantum computing, and the like, which is not limited thereto.

Various technical features of the above embodiments can be combined in any manner, for the brevity of description, not all possible combinations of the technical features in the above embodiments are described, however, as long as there is no contradiction in the combinations of these technical features, these combinations should be considered to fall within the scope recorded in the present specification.

The above embodiments only express several implementations of the present disclosure, and the description thereof is more specific and detailed, but it cannot be understood as a limitation to the patent scope of the present disclosure. It should be noted that, for those ordinary skilled in the art, several variations and improvements may be made without departing from the concept of the present disclosure, all these variations and improvements fall within the protection scope of the present disclosure. Therefore, the protection scope of the present disclosure shall be subject to the appended claims.

What is claimed is:

1. An air conditioner control system, comprising: an outdoor unit device, one main indoor unit device and at least one secondary indoor unit device, wherein, the main indoor unit device and the outdoor unit device are connected to a first communication bus, and the main indoor unit device and each of the at least one secondary indoor unit device are both connected to a second communication bus;

each of the at least one secondary indoor unit device is configured to send a secondary indoor unit state information of itself to the second communication bus;

the main indoor unit device is configured to acquire the secondary indoor unit state information of each of the at least one secondary indoor unit device via the second communication bus, and send an indoor unit state summary information to the first communication bus according to each piece of the secondary indoor unit state information and a main indoor unit state information of the main indoor unit device; and the outdoor unit device is configured to acquire the indoor unit state summary information via the first communication bus, and according to the indoor unit state summary information, determine whether there is a fault in the main indoor unit device or each of the at least one secondary indoor unit device, control itself to execute an action corresponding to the fault.

2. The air conditioner control system as claimed in claim 1, wherein the outdoor unit device is further configured to send an outdoor unit state information of itself to the first communication bus; and the main indoor unit device is further configured to receive the outdoor unit state information via the first communication bus, and control itself to perform fault shutdown, according to the outdoor unit state information, determine whether the outdoor unit device has a fault.

3. The air conditioner control system as claimed in claim 2, wherein the main indoor unit device is further configured to: when determining that the outdoor unit device has the fault, send an outdoor unit fault information to the second communication bus; and each of the at least one secondary indoor unit device is further configured to control itself to perform fault shutdown upon receiving the outdoor unit fault information via the second communication bus.

4. The air conditioner control system as claimed in claim 1, wherein the air conditioner control system further comprises: a terminal controller, which is connected to the second communication bus;

the terminal controller is configured to receive an air conditioner control instruction, and send the air conditioner control instruction to the second communication bus; and the main indoor unit device and each of the at least one secondary indoor unit device are further configured to receive the air conditioner control instruction via the second communication bus, and control working states of themselves according to the air conditioner control instruction.

5. The air conditioner control system as claimed in claim 4, wherein the terminal controller is further configured to receive each piece of the secondary indoor unit state information and the main indoor unit state information of the main indoor unit device via the second communication bus, when there is an indoor unit fault information in each piece of the secondary indoor unit state information and the main indoor unit state information, display a corresponding indoor unit fault information, or according to each piece of the secondary indoor unit state information and the main indoor unit state information, determine whether there is an indoor unit fault, display a corresponding indoor unit fault information; and send the indoor unit fault information to the second communication bus.

6. The air conditioner control system as claimed in claim 4, wherein the main indoor unit device is further configured to determine, according to each piece of the secondary indoor unit state information and the main indoor unit state information of the main indoor unit device, whether there is an indoor unit fault, and if there is the indoor unit fault, send a corresponding indoor unit fault information to the second communication bus; and the terminal controller is further configured to display the corresponding indoor unit fault information upon receiving the corresponding indoor unit fault information via the second communication bus.

7. The air conditioner control system as claimed in claim 4, wherein the main indoor unit device is further configured to: when determining that the outdoor unit device has a fault, send an outdoor unit fault information to the second communication bus; and the terminal controller is further configured to receive the outdoor unit fault information via the second communication bus, and display the outdoor unit fault information.

8. The air conditioner control system as claimed in claim 4, wherein, the main indoor unit device and each of the at least one secondary indoor unit device are further configured to: if receiving the air conditioner control instruction via the second communication bus, respectively generate a corresponding address information according to attribute information of themselves, and send the corresponding address information to the second communication bus.

9. The air conditioner control system as claimed in claim 8, wherein the terminal controller is further configured to: if receiving the corresponding address information via the second communication bus, establish association relationships with the main indoor unit device and each of the at least one secondary indoor unit device according to the corresponding address information.

10. The air conditioner control system as claimed in claim 9, wherein the main indoor unit device and each of the at least one secondary indoor unit device are further configured to generate a corresponding time response information according to the attribute information of themselves, and output the corresponding address information and the corresponding time response information to the terminal controller.

11. The air conditioner control system as claimed in claim 1, wherein the outdoor unit device is further configured to: when determining that there is a fault in the main indoor unit device or each of the at least one secondary indoor unit device, according to a type of the fault, control itself to perform fault shutdown or maintain current state for running.

12. A control method of an air conditioner control system, wherein a main indoor unit device and an outdoor unit device of the air conditioner control system are connected to a first communication bus, the main indoor unit device and each of at least one secondary indoor unit device are both connected to a second communication bus, and the control method comprises:

each of the at least one secondary indoor unit device sends a secondary indoor unit state information of itself to the second communication bus;

the main indoor unit device acquires the secondary indoor unit state information of each of the at least one secondary indoor unit device via the second communication bus, and sends an indoor unit state summary information to the first communication bus according to each piece of the secondary indoor unit state information and a main indoor unit state information of the main indoor unit device; and the outdoor unit device acquires the indoor unit state summary information via the first communication bus, and according to the indoor unit state summary information, determine whether that there is a fault in the main indoor unit device or each of the at least one secondary indoor unit device, controls itself to execute an action corresponding to the fault.

13. The control method as claimed in claim 12, further comprising:

the outdoor unit device sends an outdoor unit state information of itself to the first communication bus; and the main indoor unit device receives the outdoor unit state information via the first communication bus, and controls itself to perform fault shutdown, according to the outdoor unit state information, determine whether that the outdoor unit device has a fault.

14. The control method as claimed in claim 13, further comprising:

when determining that the outdoor unit device has the fault, the main indoor unit device sends an outdoor unit fault information to the second communication bus; and upon receiving the outdoor unit fault information via the second communication bus, each of the at least one secondary indoor unit device controls itself to perform fault shutdown.

15. The control method as claimed in claim 14, further comprising:

the main indoor unit device determines, according to each piece of the secondary indoor unit state information and the main indoor unit state information of the main indoor unit device, whether there is an indoor unit fault, and if there is the indoor unit fault, sends a corresponding indoor unit fault information to the second communication bus; and upon receiving the corresponding indoor unit fault information via the second communication bus, the terminal controller displays the corresponding indoor unit fault information.

16. The control method as claimed in claim 12, further comprising:

a terminal controller receives an air conditioner control instruction, and sends the air conditioner control instruction to the second communication bus; and the main indoor unit device and each of the at least one secondary indoor unit device receive the air conditioner control instruction via the second communication bus, and control working states of themselves according to the air conditioner control instruction.

17. The control method as claimed in claim 16, further comprising:

the terminal controller receives each piece of the secondary indoor unit state information and the main indoor unit state information of the main indoor unit device via the second communication bus; and when there is an indoor unit fault information in each piece of the secondary indoor unit state information and the main indoor unit state information, displays a corresponding indoor unit fault information, or according to each piece of the secondary indoor unit state information and the main indoor unit state information, determine whether that there is an indoor unit fault, displays a corresponding indoor unit fault information; and sends the indoor unit fault information to the second communication bus.

18. The control method as claimed in claim 16, further comprising:

when determining that the outdoor unit device has a fault, the main indoor unit device sends an outdoor unit fault information to the second communication bus; and the terminal controller receives the outdoor unit fault information via the second communication bus, and displays the outdoor unit fault information.

19. The control method as claimed in claim 16, further comprising:

if receiving the air conditioner control instruction via the second communication bus, the main indoor unit device and each of the at least one secondary indoor unit device respectively generates a corresponding address information according to attribute information of themselves, and sends the corresponding address information to the second communication bus.

20. The control method as claimed in claim 19, further comprising:

if receiving the corresponding address information via the second communication bus, the terminal controller establishes association relationships with the main indoor unit device and each of the at least one secondary indoor unit device according to the corresponding address information.

* * * * *